US006193505B1

(12) United States Patent
Schleiffer et al.

(10) Patent No.: US 6,193,505 B1
(45) Date of Patent: Feb. 27, 2001

(54) ROLLING BODY FOR A ROTARY DRUM AND ROTARY DRUM WITH A ROLLING BODY

(75) Inventors: Andreas Schleiffer, Dorsten; Peter Wenning, Train, both of (DE)

(73) Assignee: Veba Oel Technologie und Automatisierung GmbH (DE)

( * ) Notice: Subject to any disclaimer, the term of this patent is extended or adjusted under 35 U.S.C. 154(b) by 0 days.

(21) Appl. No.: 09/380,694

(22) PCT Filed: Mar. 6, 1998

(86) PCT No.: PCT/EP98/01332

§ 371 Date: Nov. 15, 1999

§ 102(e) Date: Nov. 15, 1999

(87) PCT Pub. No.: WO98/39611

PCT Pub. Date: Sep. 11, 1998

(30) Foreign Application Priority Data

Mar. 6, 1997 (DE) ..... 297 04 044 U

(51) Int. Cl.[7] ..... F27D 23/02

(52) U.S. Cl. ..... 432/103; 432/75; 432/106

(58) Field of Search ..... 432/75, 103, 106, 432/114, 118, 141, 151, 206; 373/85, 87; 366/244, 254, 255

(56) References Cited

U.S. PATENT DOCUMENTS

| | | | | |
|---|---|---|---|---|
| 4,775,315 | * | 10/1988 | Schweder et al. | 432/75 |
| 5,082,441 | * | 1/1992 | Schweder et al. | 432/75 |
| 6,000,936 | * | 12/1999 | Taquet | 432/103 |

FOREIGN PATENT DOCUMENTS

| | | |
|---|---|---|
| 402 290 | 9/1924 | (DE) . |
| 447 191 | 7/1927 | (DE) . |
| 36 41 731 | 6/1988 | (DE) . |
| 0 205 651 | 9/1985 | (EP) . |
| 0 340 438 | 3/1989 | (EP) . |
| 0 342 417 | 4/1989 | (EP) . |
| 804 688 | 10/1936 | (FR) . |

* cited by examiner

*Primary Examiner*—Denise L. Ferensic
*Assistant Examiner*—Gregory A. Wilson
(74) *Attorney, Agent, or Firm*—Vickers, Daniels & Young

(57) ABSTRACT

A revolving drum containing a rolling element is provided that includes a member for the cleaning of the inner wall areas of the revolving drum which has at least two cleaning zones. The cleaning zones include projecting cleaning elements and lie in tandem in an axial direction of the revolving drum. They include a fastening apparatus disposed on a front end pointing toward the infeed side of the drum and include a revolving articulation by which the rolling element can be fastened to a non-revolving component of a head of the revolving drum. The cleaning zones comprise generated surfaces of the revolving drum which are at an angle to one another.

11 Claims, 2 Drawing Sheets

ROLLING BODY FOR A ROTARY DRUM AND ROTARY DRUM WITH A ROLLING BODY

DESCRIPTION

The present invention relates to rolling element for a revolving drum with the generic characteristics of claim 1 as well as a revolving drum having a rolling element with the generic characteristics of claim 5.

Revolving drums, also known as rotating tubes, are used in various thermal treatment processes such as in drying, distilling tar, and many others with direct or indirect heating of the interior of the drum conveying the product to be treated. Due to the inclination of many treated products to bake on the walls of the interior of the drum, cleaning devices are used in the interior of the drum. For this purpose rolling elements lying loose in the interior of the revolving drum are known which as a rule have on their outer surface projections such as helical strips, which serve to clean, and, in the revolving drum, execute movements relative to the inner wall of the drum with cleaning effect due to their configuration and/or support. Rolling elements of this type and revolving drums having such are described in DE 36 41 731 A1.

Particular problems of baking-on occur on the interior wall of the revolving drum during the distillation of materials containing hydrocarbon substances such as remnants of the hydrogenation of heavy oil or coal. In that case vapors of heavy oils condense due to high loss of heat outside of the heated zone of the revolving drum. Thereby, along with heat transfer problems, conveyance problems occur in the infeed and discharge area of the revolving drum. Furthermore, the cleaning of the baked-on deposits must be done carefully in order to keep wear of the revolving drum within acceptable limits. Finally baked-on deposits which are extremely different from one another can occur within the interior of the revolving drum because the product to be treated experiences chemical and/or physical conversions between the infeed and discharge ends. For example, in the case of a distillation process in the revolving drum the thermal cracking of hydrocarbon substances is done on the inner wall of the drum, which is hotter than 420° C. During the thermal cracking the resulting coke passes through a plastic state and forms in this zone viscous baked-on deposits on the wall of the drum. In the area of the discharge zone the baked-on deposits reach the state of solid agglomerations. Baked-on deposits arise in the infeed zone from products of cracking which are loaded with dust, which hinders the infeed of material.

The inventors have recognized that for an effective furthering of the process in the revolving drum, a particularly thorough cleaning of the front zone, i. e. the infeed zone of the revolving drum and therefore an area in which the product to be treated has significant gaseous and liquid components, is particularly important and that on the other hand, cleaning of the interior of the revolving drum in its back area; in particular, in the area of the discharge zone in which the product to be treated, in so far as it does not remain gaseous, is essentially solid or only relatively slightly moist should be done in as protective a manner as possible; in particular, in such a manner that the development of dust during cleaning of the baked-on deposits is held within limits which are as narrow as possible.

SUMMARY OF THE INVENTION

Therefore, the objective of the invention is to provide a solution with which the wall area of the infeed zone of a revolving drum is cleaned particularly effectively. To the extent possible the cleaning device should avoid excessive development of dust in the rear area of the drum.

For the realization of this objective, a novel rolling element is proposed according which is formed comprising one or more members and has at least two cleaning zones which clean the faces of the inner wall that are at an angle to one another seen in the axial direction of the revolving drum, at least in the infeed zone of the revolving drum, and the rolling element comprising one or more members has, on its front end pointing toward the infeed side of the drum, a fastening apparatus having a revolving articulation joint by means of which the rolling element can be fastened to a component of the head of the revolving drum not revolving, particularly, the cover.

A fastenable rolling element equipped in this way is positioned to thoroughly clean the inner wall of the revolving drum precisely in that area in which the cross section of the inner drum is tapered conically or in steps, as seen in the direction of the infeed side of the drum. Due to the revolving articulation, the rolling element can execute a combined revolving and rolling motion, and therefore motions relative to the inner wall of the revolving drum immediately adjacent it, without the rolling element being removed significantly from the surface areas standing at an angle to one another which are to be cleaned, in particular the contact zone between these surface areas. The rolling element is thereby additionally prevented from executing noticeable axial scraping motions in its end area on the discharge side, so that an excessive development of dust in the area of baked-on deposits in a state of predominantly solid agglomeration is relatively effectively avoided.

A rolling element according to the invention can be formed in particular of one or two members where, in an embodiment comprising two or more members, the rolling elements lying in tandem are articulated together such that the axes about which the individual rolling elements essentially revolve can be at an angle to one another. Preferably articulations of this type are also such that the angular speed with which the individual rolling element members revolve can be different from rolling element to rolling element. Particularly preferably multi-member rolling elements can execute a snake-like motion seen parallel to the axial direction of the revolving drum so that the entire rolling element in addition to the revolving motion about the rolling element axis/axes can also execute a wagging motion like a dog's tail.

In the case of multi-member rolling elements, the end of one member can, if desired, dip into a recess, in particular an annular one, of the end of the other member so that in the case of a angled position of the rolling element members with respect to one another the gap area between adjacent rolling element members, which has no surfaces active in cleaning, can be held very small.

A multi-member rolling element of this type can be connected to a non-corevolving head area, not shown, of the revolving drum in particular the drum cover, by means of an intermediate member which has an articulation at its end in order to intensify the dogtail-like wagging motion component of the rolling element. This intermediate member can be formed as a pure drawing means as well as drawing/pressing means, but can serve as the first member of a multi-member rolling element and in particular, with elements on its outer jacket periphery malting possible a cleaning of the interior of the drum.

The objective of the invention is furthermore realized by a revolving drum having a rolling element in which the rolling element is attached, in particular, to the non-revolving part of the head of the drum with the interposition of a revolving articulation and the rolling element has a front edge which by means of the attached apparatus of the revolving articulation is held in the area of a constricting edge of the revolving drum and thus an intensive cleaning is possible not only in the cylindrical revolving drum part but also in the transitional area of the cross-sectionally tapered head of the revolving drum. In the case of a revolving drum of this type equipped with a rolling element, scraping forces in the transitional area of the cross-sectionally tapered zones are made usable which, despite a simple and low-wear configuration of the means used, leads to a surprisingly intensive and effective cleaning of the surface of this particularly critical revolving drum area.

Rolling elements according to the invention or usable according to the invention can have basic forms and surface configurations varying over a wide range. They can in particular be cylindrical, conical, or club-like, or be hollow or of solid material with strip-like, spiral, pointed, or other surface projections as cleaning elements, or of a hollow framework-like structure in which the cleaning elements form a virtual rolling element surface (outside): The cleaning elements can also take over at least a reinforcing function of the rolling elements.

While ball-and-socket joints are particularly advantageous as revolving articulations, Cardan and flexible elastic revolving articulations can also be used.

Expedient refinements of the object of the invention which, in particular, insure an intensive or low-wear cleaning of the inner surface of the drum, particularly in the infeed half of the revolving drum, are contained in the subordinate claims.

The aforementioned components to be used according to the invention, as well as those claimed or described in the embodiment, are based on no particular exceptional conditions with regard to their size, structural form, choice of material, and technical conception, so that the selection criteria in the respective field of application can be used without restriction.

Additional details and advantages of the object of the invention follow from the subsequent description of the accompanying drawings in which, by way of example, preferred embodiments are represented. In the drawings are shown;

DETAILED DESCRIPTION OF THE INVENTION

Figure 1:
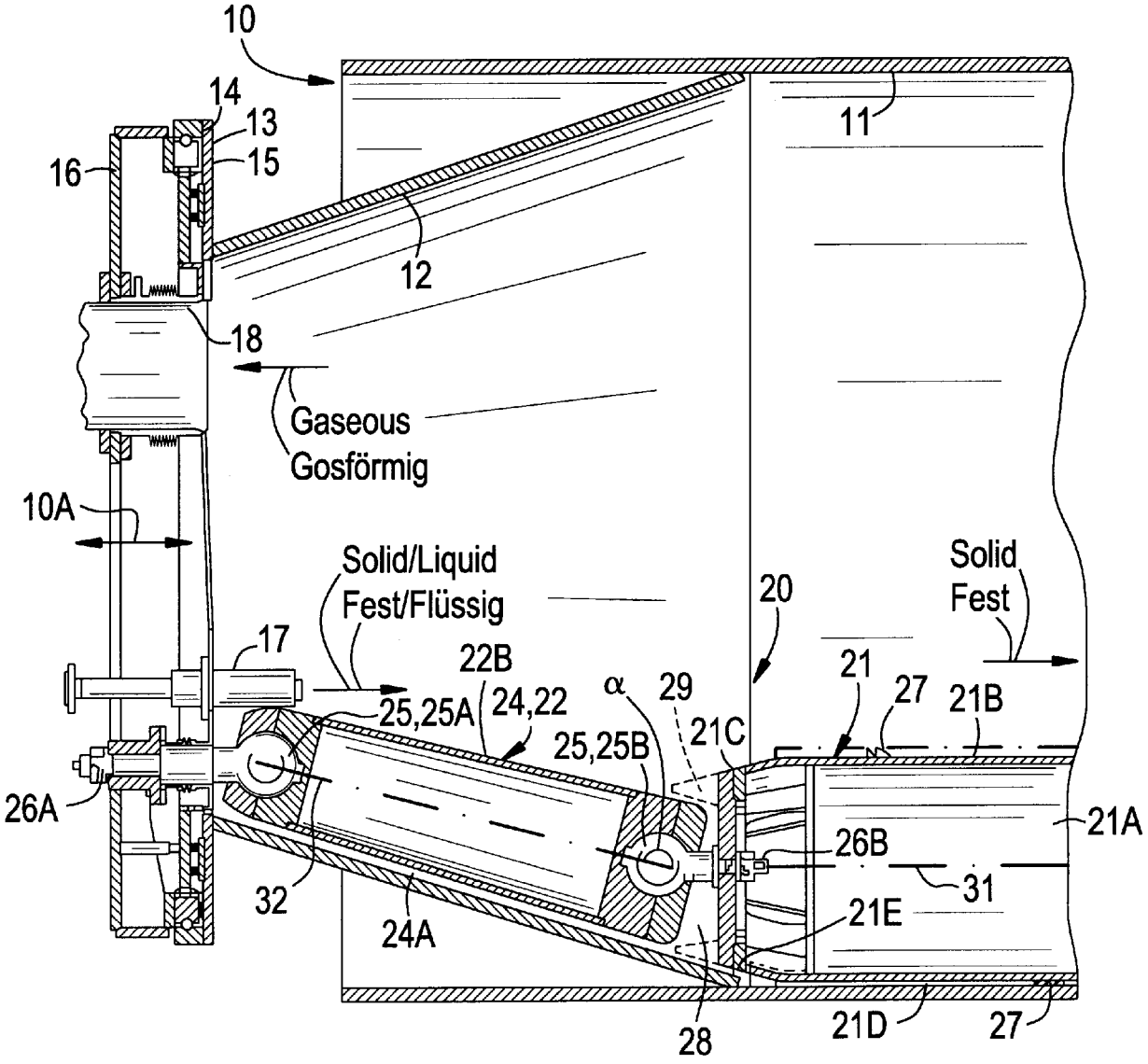
FIG. 1, a revolving drum in longitudinal view with a rolling element in its area on the entry side in cutaway, FIG. 2, the same revolving drum with another rolling element, this time in lateral view, as well as FIG. 3, the same revolving drum with still another rolling element, this time also in lateral view.

The revolving drum designated overall as 10 in FIG. 1 is represented merely schematically, in particular without insulation, heating, and revolving apparatuses. It consists of a cylindrical wall part 11 and at each of its two ends, a conical wall part 12, as well as a flange 13 which is seated tightly sealed but free to rotate on a rotationally fixed cover 16 by positioning and sealing means 14 and 15 in a conventional manner. The insulating, heating, and revolving drive means of the revolving drum are conventional and left out in the drawing, since they are not part of the object of the invention. The cover 16 is provided with a material feed 17 and a gas suction connector 18.

A rolling element, designated overall as 20, for cleaning of the inner wall of the drum, at least in the area of the head on the entry side represented, consists of a one-part rolling element member 21 which via an intermediate member 24 is connected to the cover 16 free to swivel in all directions and revolve via two revolving articulations constructed as ball and sockets 25A and 25B. For this purpose the ball and socket 25A is firmly connected to the cover 16 via a screw 26A and the ball and socket 25B is firmly connected to a front wall 21A of the rolling element member 21 by means of a screw 26B.

The intermediate member 24 is configured as a conical hollow body which tapers in cross section in the direction of the cover 16 and whose outer peripheral face (generated surface) is held a small, approximately uniform distance apart from the conical wall part 12 of the revolving drum 10. Baked-on deposits which are thicker than the thickness of the spacing gap 24A therefore cannot form, as a rule, so that the intermediate member 24 also generally assumes the function of a second rolling element member 22. Naturally, this intermediate or second rolling element member 24, 22 can also be provided with cleaning elements near the surface, such as are realized on the first rolling element member 21 in the form of the spiral cleaning strip 27.

The first rolling element member 21 has a cylindrical surface zone 21B as well as a conical surface zone 21C adjacent thereto in the direction toward the cover 16. These surface zones, or generated surfaces, are associated, on the one hand, with the cylindrical wall part 11 of the revolving drum 10 and, on the other, with the conical wall part 12 of the revolving drum 10 such that the respective cylindrical and the respective conical surface zones form a gap 21D or a gap 21E. These gaps define the zones of contact or zones of least mutual separation. Due to the approximately equally-sized conical angles of the conical zone 21C of the first rolling element member 21 and of the conical wall part 12 of the revolving drum 10, the gap 21E is approximately uniformly wide. Even without having particular cleaning elements, the conical zone 21C has a cleaning effect (as is the case for the intermediate member 24 or second rolling element member 22). Cleaning elements can of course be provided in addition to enhance the cleaning effect. The rolling element member 21A therefore cleans two zones of the surface of the revolving drum 10 at an angle to one another in a single operational process and also covers the transitional area of these two zones of the surface.

In order to achieve a thorough cleaning effect for coupled rolling element members whose rolling axes 31, 32, as in the embodiment of FIG. 1, form an angle alpha, the front face of the one rolling element member 21 has a central recess 28 into which the front end of the adjacent rolling element member 22 can dip at least partially. The same effect is achieved if the outer wall forming the conical zone 21C of the first rolling element member 21 extends out over the front wall 21A, in particular flushly, and thereby the spacing gap to the second rolling element member 22 is largely covered on the outer side of the break. In FIG. 1 a front ring 29 is thus represented, merely by way of example.

Figure 2:
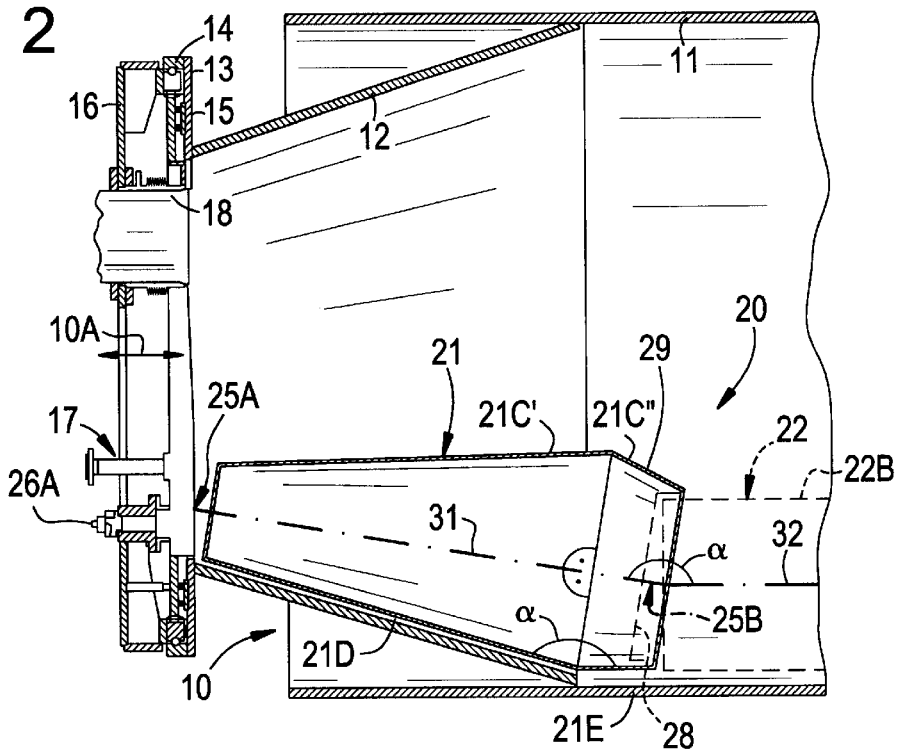

In the embodiment according to FIG. 2, a first rolling element member 21 is formed in lobular shape and has a first conical surface zone 21C' and a second conical surface zone 21C". Both have a common rolling axis 31 and form the generated surfaces of two frustums which are connected to one another on an equally large base with opposing, if necessary, different conicities. The individual rolling element attachment to a positionally fixed end wall of the revolving drum 10, not represented in greater detail, can be configured similarly to the ball and socket 25A. The cleaning of the revolving faces 11 and 12 is done in a similar manner to that described in connection with FIG. 1.

A second rolling element member 22 can adjoin this first rolling element member 21 in a similar manner, as represented in FIG. 1. This is reproduced in FIG. 2 with dotted lines. As a further alternative in the case of multiple rolling elements, each of the rolling element members can also be provided with only one cleaning zone and individual rolling element members can form an angle deviating from 180° and be assigned to zones of the revolving drum, each inclined differently.

Figure 3:
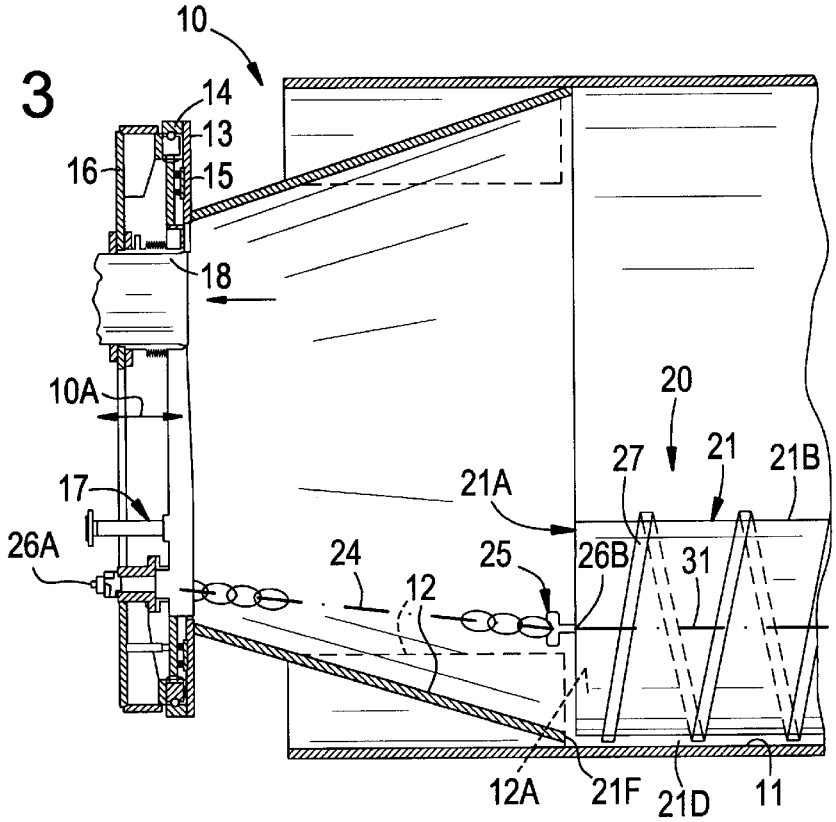

Finally, FIG. 3 shows a conical first rolling element member 21 which is in turn fastened by an intermediate member 24 formed as a chain to a positionally fixed end area of the revolving drum 10 and is connected in the center to the front wall 21A on the entry side via a revolving articulation 25 in the manner of a Cardan joint. The edge 21F on the front side formed between the front inner wall 21A and the generated surface 21B of the cone is disposed in the area of the break between the conical and cylindrical wall part of the revolving drum 10 such that even the zone of conical tapering is cleaned, at least in the transitional area. Such a cleaning effect also occurs if the cross-sectional tapering of the revolving drum 10 is not configured conically but rather in steps as represented in FIG. 3 by dotted lines.

Having thus described the invention, it is claimed:

1. A revolving drum containing a rolling element, comprising at least one member for the cleaning of inner wall areas of the revolving drum having at least two cleaning zones which have projecting cleaning elements and lie in tandem in an axial direction of the revolving drum and including a fastening apparatus disposed on a front end pointing toward the infeed side of the drum which includes a revolving articulation, by means of which the rolling element can be fastened to a non-revolving component of a head of the revolving drum, wherein said cleaning zones comprise generated surfaces of the revolving drum which are at an angle to one another.

2. The revolving drum of claim 1, wherein the revolving drum has a transitional area between the generated surfaces which is held by means of the fastening apparatus in an area of a constricting edge of the revolving drum.

3. The revolving drum of claim 1, wherein the generated surfaces are associated with the cylindrical and conical wall parts of the drum body, and maintain a gap therebetween.

4. The rolling element of claim 3, comprising multiple members and that the end of the member of the one rolling element member has at least one central recess of circular structure, into which the end of the member of the immediately adjacent rolling element member can partially dip when the spacing gap is reduced.

5. A revolving drum containing a rolling element comprising at least one member cleaning the inner wall areas of the revolving drum with at least one cleaning zone which has projecting cleaning elements and with a fastening apparatus disposed on a front end pointing toward the infeed side of the drum which has a revolving articulation by means of which the rolling element can be fastened to a non-revolving component of the head of the revolving drum, wherein at least one cleaning zone is formed in the form of a generated surface and the rolling element has a front edge which is held by means of the fastening apparatus in the area of a constricting edge of the revolving drum.

6. The revolving drum of claim 5, wherein the rolling elements comprise multiple members, the rolling element members lying in tandem are articulated to one another such that the rolling axes about which the individual rolling elements essentially revolve are at an angle to one another deviating from 180°, each rolling element member having at least one cleaning zone.

7. The revolving drum of claim 6, wherein an end of the one rolling element member has at least one central recess of a circular form, into which the end of the member of an immediately adjacent rolling element member can partially dip when the spacing gap is reduced.

8. The revolving drum of claim 7, wherein an intermediate member which has revolving articulations on its ends, by means of which the intermediate member is connected or can be connected at one end to the head area of the revolving drum and at the other end to the rolling element.

9. The revolving drum of claim 5, including at least one ball and socket serving as the revolving articulation.

10. The revolving drum of claim 5, wherein the rolling element can be fastened to a cover of the revolving drum.

11. A rolling element for cleaning the inner wall areas of the drum with at least two cleaning zones which have cleaning elements, lying in tandem seen in the axial direction of the rolling element, and projecting and with a fastening apparatus disposed on said fastening apparatus front end which has a revolving articulation by means of which the rolling element can be fastened to a non-revolving part, and the cleaning zones comprise generated surfaces of the rolling element which are at an angle to one another.

* * * * *